US007731050B2

(12) United States Patent
Parks et al.

(10) Patent No.: US 7,731,050 B2
(45) Date of Patent: Jun. 8, 2010

(54) CONTAINER AND CLOSURE COMBINATION INCLUDING SPREADING AND LIFTING CAMS

(75) Inventors: Lawrence A. Parks, Shelby Township, MI (US); Harold E. Zell, St. Simons Island, GA (US)

(73) Assignee: Efficient Container Company, St. Simons Island, GA (US)

( * ) Notice: Subject to any disclaimer, the term of this patent is extended or adjusted under 35 U.S.C. 154(b) by 1065 days.

(21) Appl. No.: 10/555,047

(22) PCT Filed: Jun. 9, 2004

(86) PCT No.: PCT/US2004/018351

§ 371 (c)(1),
(2), (4) Date: Oct. 28, 2005

(87) PCT Pub. No.: WO2005/000700

PCT Pub. Date: Jan. 6, 2005

(65) Prior Publication Data

US 2006/0255041 A1 Nov. 16, 2006

Related U.S. Application Data

(60) Provisional application No. 60/477,759, filed on Jun. 10, 2003.

(51) Int. Cl.

| | |
|---|---|
| ***B65D 41/06*** | (2006.01) |
| ***B65D 53/00*** | (2006.01) |
| ***B65D 41/18*** | (2006.01) |
| ***B65D 21/00*** | (2006.01) |

(52) U.S. Cl. ..... 220/301; 215/318; 215/344; 206/509; 220/780; 220/788

(58) Field of Classification Search ..... 220/788, 220/301, 295; 215/318, 321, 329, 339, 336, 215/295; 206/508
See application file for complete search history.

(56) References Cited

U.S. PATENT DOCUMENTS

| | | | | |
|---|---|---|---|---|
| 1,300,252 | A * | 4/1919 | Doldt | 215/339 |
| 1,333,245 | A * | 3/1920 | Carson | 215/295 |
| 3,836,034 | A | 9/1974 | Lecinski, Jr. | |
| 4,000,825 | A | 1/1977 | Westfall | |
| 4,006,837 | A | 2/1977 | Gates et al. | |
| 4,091,948 | A * | 5/1978 | Northup | 215/222 |
| 4,117,946 | A | 10/1978 | Kessler | |
| 4,298,129 | A | 11/1981 | Stull | |
| 4,373,633 | A | 2/1983 | Lutz, Sr. | |
| 4,562,930 | A | 1/1986 | Lecinski, Jr. et al. | |
| 4,709,825 | A | 12/1987 | Mumford | |

(Continued)

FOREIGN PATENT DOCUMENTS

| | | |
|---|---|---|
| EP | 0 330 473 A1 | 2/1989 |

(Continued)

*Primary Examiner*—Robin Hylton
(74) *Attorney, Agent, or Firm*—Fraser Clemens Martin & Miller LLC; Donald R. Fraser

(57) ABSTRACT

A closure (40) and container (10) combination which includes a closing and opening assist mechanism (22, 28, 28', 30, 30') which provides for spreading the locking mechanism (46) of the closure and causing a lifting movement of the closure to effect the removal of the closure from the container.

22 Claims, 8 Drawing Sheets

U.S. PATENT DOCUMENTS

| | | | |
|---|---|---|---|
| 4,919,268 | A | 4/1990 | Young et al. |
| 5,054,617 | A | 10/1991 | Young et al. |
| 5,297,688 | A | 3/1994 | Beck et al. |
| 5,310,071 | A | 5/1994 | Rivlin et al. |
| 5,339,975 | A | 8/1994 | Stoner |
| 5,447,249 | A | 9/1995 | Vickers |
| 5,769,255 | A | 6/1998 | Ohmi et al. |
| 6,202,872 | B1 | 3/2001 | Smeyak et al. |
| 6,477,823 | B1 | 11/2002 | Kitterman et al. |
| 2002/0175138 | A1 | 11/2002 | Martin et al. |
| 2002/0190022 | A1 | 12/2002 | Pitassi |
| 2003/0051445 | A1 | 3/2003 | Martin et al. |

FOREIGN PATENT DOCUMENTS

| | | |
|---|---|---|
| FR | 2060957 | 9/1970 |
| IT | 1117839 | 2/1986 |
| WO | WO 97/19864 A1 | 6/1997 |

* cited by examiner

CONTAINER AND CLOSURE COMBINATION INCLUDING SPREADING AND LIFTING CAMS

This application claims the benefit of U.S. provisional patent application Ser. No. 60/477,759, filed Jun. 10, 2003.

BACKGROUND OF THE INVENTION

1. Field of the Invention

The present invention relates to packaging and more particularly to a combination of a container and an associated closure therefor capable of efficiently containing and storing various fluid products including liquids and fluent solid materials.

2. Description of the Prior Art

While the packaging industry is familiar with polygonally-shaped containers to obtain the most efficient utilization of shipping, storing and displaying space, the utilization of similarly configured closures providing ready access to the contents are not available. Closures adapted to be received by typical externally threaded finishes are well known and have been found to be generally acceptable, particularly where annular or round finishes are employed. However, it is considered that in many instances it would be desirable to utilize a polygonal container having a polygonal finish. Such a design provides for efficiency in packaging, shipping, storing, and displaying the product, but poses serious problems in respect of closure design. One of the types of closure for such finishes is the "press-on" or "snap-on" type.

Several types of "press-on" or "snap-on" container closures are presently known for the packaging of products. A common feature of these closures is that the closure and the associated finish are provided with cams, ribs, or threads that allow the closure to be "snapped" or "pressed" onto the container to a closed position over an opening in the top of the finish of the container.

The removal of the closure in "press-on" or "snap-on" container systems can occur in a variety of ways. A common method of removing the closure is to push or pull the closure off of an engaging rim of the container. The closure structure and means of removal are commonly employed in the construction of closures for aspirin containers. Another means for removing the closure involves pushing on the sides of the closure to deform the shape of the closure slightly so that ribs or cams on the closure are caused to be disengaged from those on the container, thus releasing the closure from the container. Another means employed for removing the closure involves twisting the closure about the vertical axis of the container to release ribs or threads. Generally, these twist-off systems require the user to push the closure downwardly while simultaneously twisting to disengage the threads or ribs on the closure from those on the container. In container systems not requiring the closure to be pushed downwardly during the twisting motion, the shape of the finish often requires that a relatively large twisting force be applied before the engaged cams, ribs, or threads will disengage to release the closure from the container.

Each of the aforementioned structures requires the user to apply a relatively large force to overcome the engaged relationship of the cams, ribs, or threads on the closure and container, or to apply a dual set of forces, such as in the combined push-and-twist removal system. Therefore, such container closures often pose difficulties for persons with little hand strength, such as the elderly and the disabled.

It would be advantageous to provide a container system that lacks the disadvantages of the container systems described above while simultaneously being attractive and of simple design, allowing for ease in manufacture.

It is an object of the present invention to produce a container and closure combination which includes an opening assist structure allowing the container to be opened readily with a minimum amount of force while not compromising the reliability of the closure when it is in an operative closed position on the container.

Another object of the invention is to produce a container and closure combination wherein both the container and the closure are provided with a plurality of cooperating locking tabs that reliably retain the closure over the finish of the container.

Still another object of the invention is to produce a container and closure combination which includes an opening assist structure permitting the closure to be easily opened with a minimum amount of force, without pressing downwardly or pulling upwardly, while maintaining the sealing reliability of the closure when in closed relationship with the container.

Another object of the invention is to produce a container and closure combination wherein the closure and container are provided with a means for lifting the closure and a means for spreading the skirt of the closure away from the finish of the container to provide a "snap-on/pop-off" feature of the container and closure combination.

SUMMARY OF THE INVENTION

The above as well as other objects of the invention may typically be achieved by a container and closure combination comprising: a container including a bottom wall, an associated side wall defining a hollow interior, a finish having an outer surface and an inner surface, the finish providing communication with the hollow interior and having a central axis, and a first locking means on the outer surface of the finish; and a closure to cover the finish of the container including a second locking means cooperating with the first locking means of the container, the closure having a central axis, whereby upon relative rotational movement of the closure and the container, the first locking means of the container and the second locking means of the closure are caused to flex away from one another transversely of the central axes of the container and the closure to cause relative movement of the container and the closure generally parallel to the central axes of the container and the closure to effectively separate the closure from the finish of the container.

BRIEF DESCRIPTION OF THE DRAWINGS

The above, as well as other objects and advantages of the invention will become clearly manifest to those skilled in the art from reading the following detailed description of a preferred embodiment of the invention when considered in the light of the accompanying drawings, in which.

DETAILED DESCRIPTION OF THE PREFERRED EMBODIMENT

Figure 1:
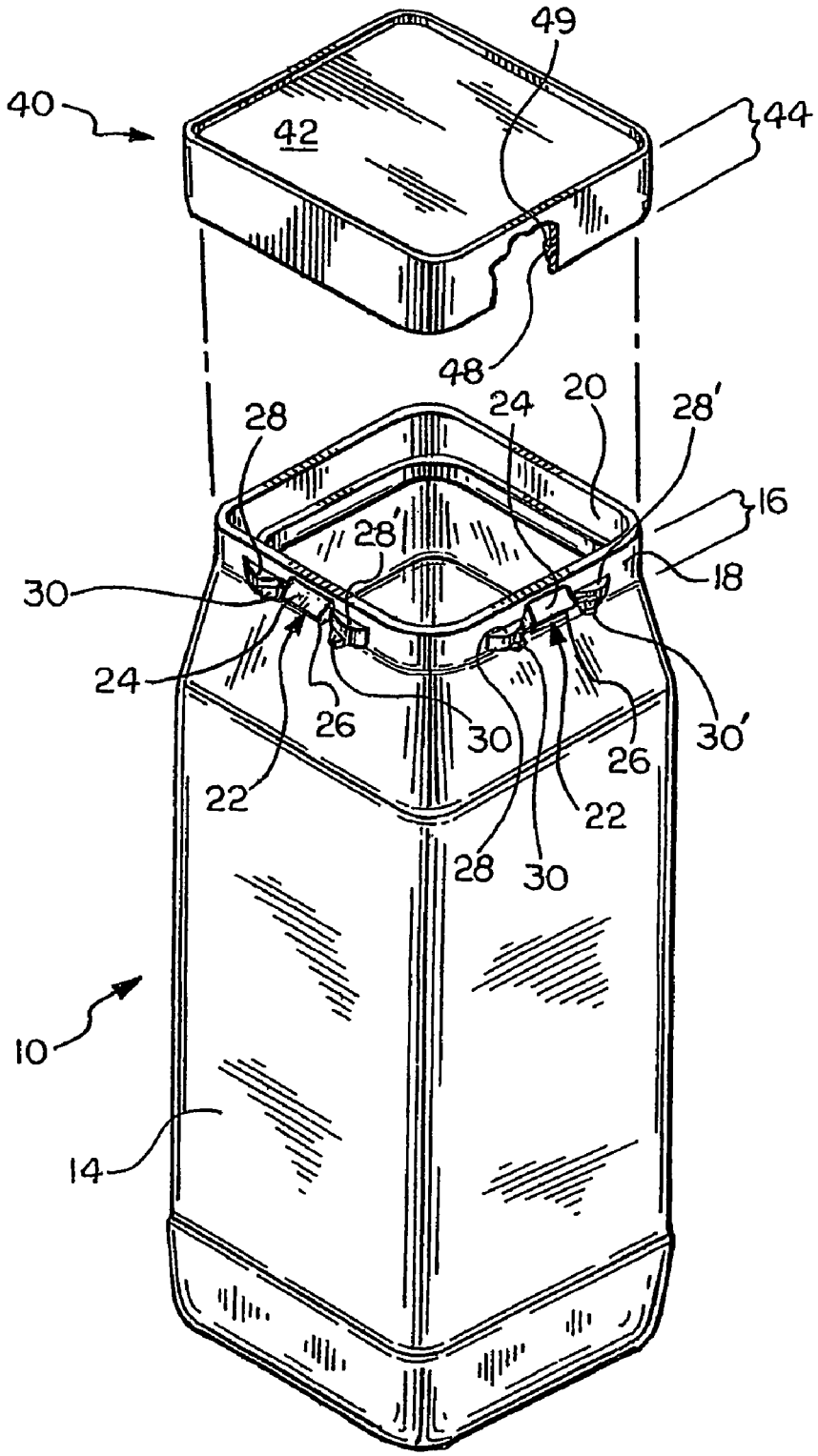
FIG. 1 is an exploded perspective view with a portion broken away of a container and closure combination embodiment of the invention.
Figure 1A:
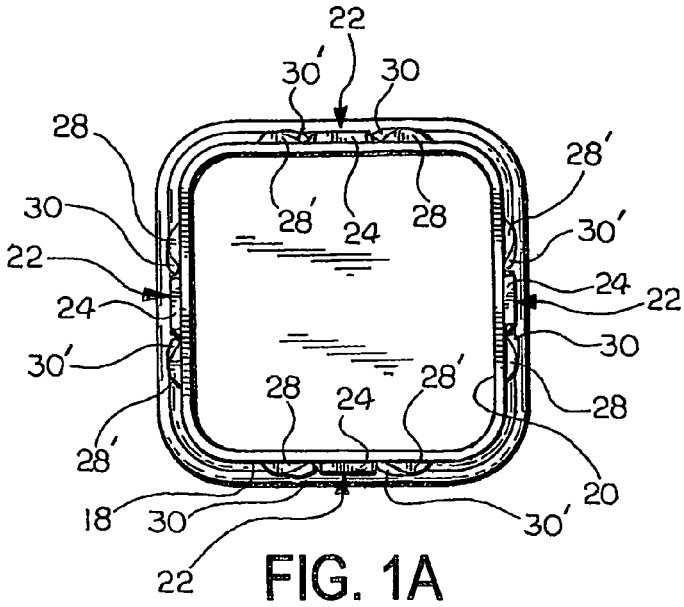
FIG. 1A is a top plan view of the container illustrated in FIG. 1.
Figure 1B:
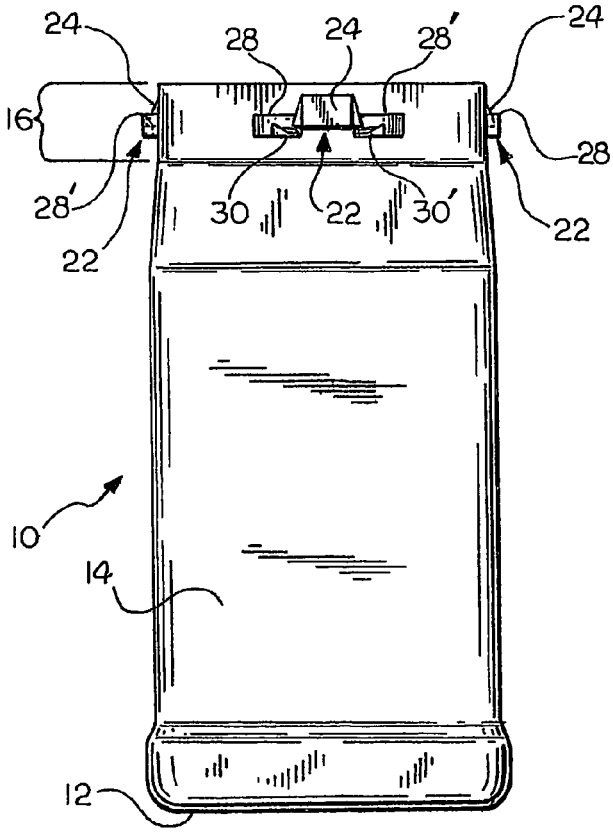
FIG. 1B is an elevational view of the container illustrated in FIGS. 1 and 1A.
Figure 2:
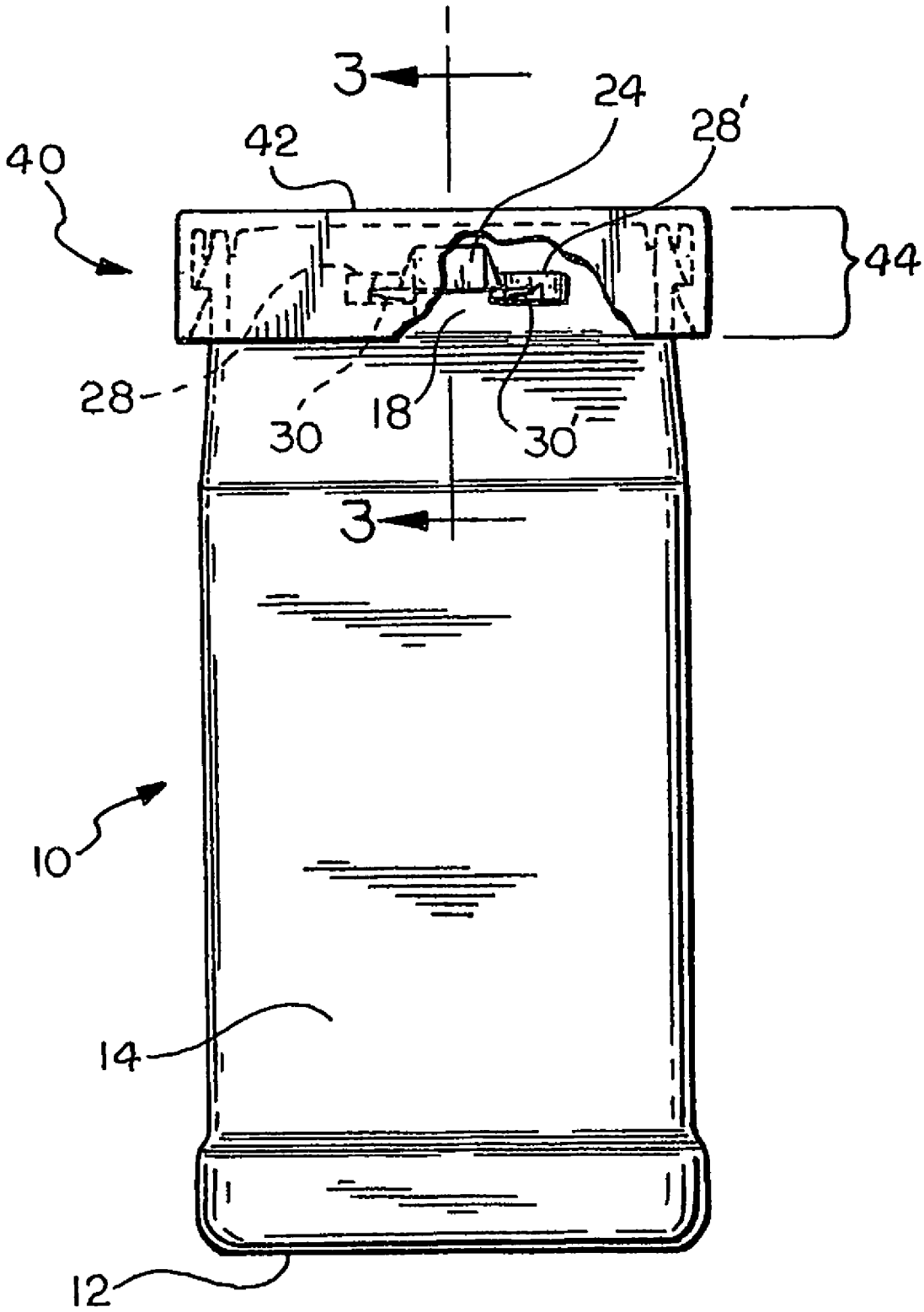
FIG. 2 is an elevational view with a portion broken away of the container and closure combination illustrated in FIG. 1.
Figure 3:
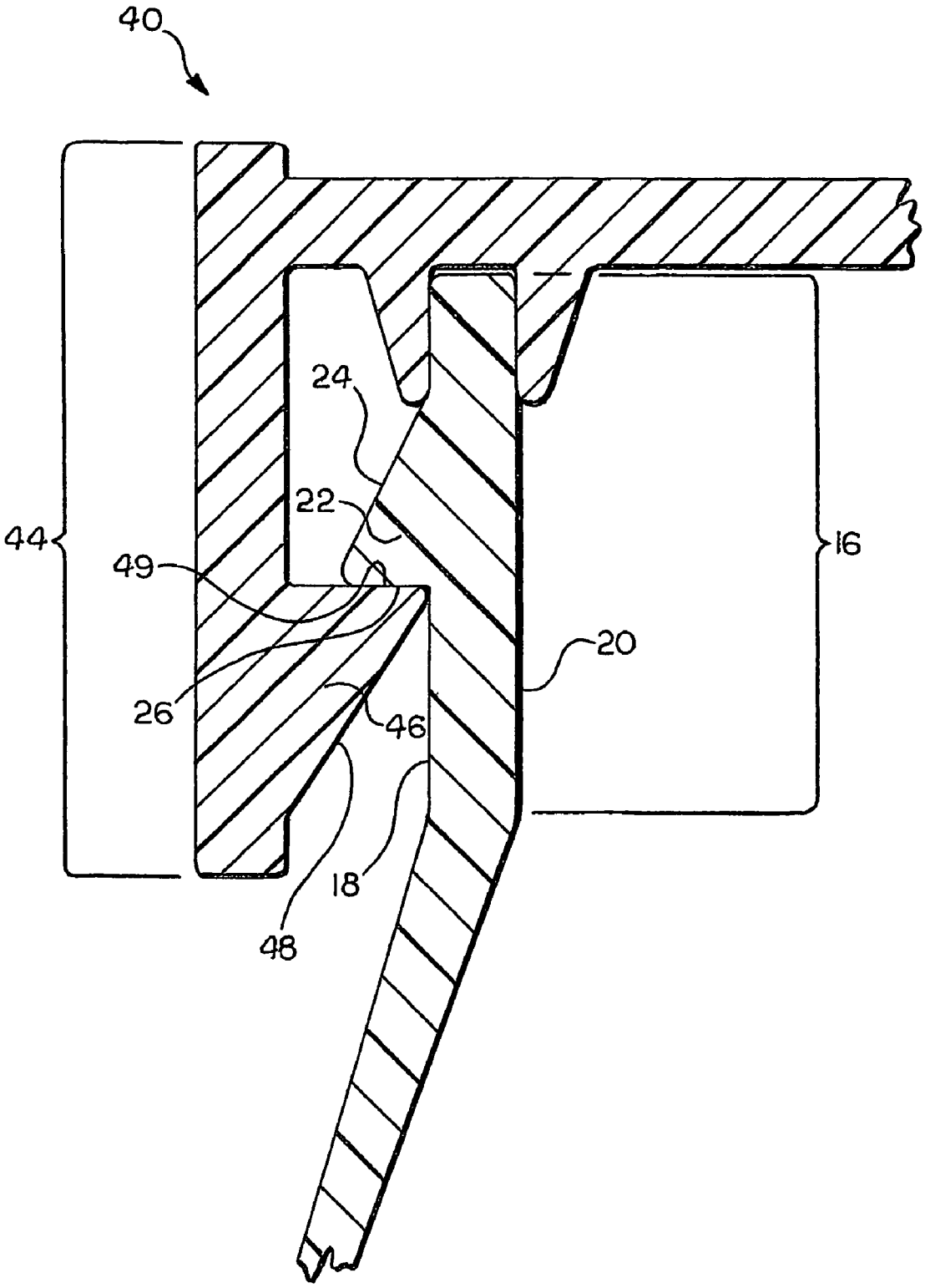
FIG. 3 is an enlarged fragmentary sectional view taken along line 3-3 of FIG. 2.

Referring to the drawings and more particularly to FIGS. 1 through 3 there is illustrated a container and closure combination containing features of the present invention. The container, generally indicated by reference numeral 10, and the closure, generally indicated by reference numeral 40, are illustrative of an embodiment of the invention.

The container 10 includes a bottom wall 12 and an associated side wall 14 which extends upwardly and terminates in a finish 16. The bottom wall 12, the side wall 14, and the finish 16 define a hollow interior for containing product. The finish 16 is provided with an outer surface 18 and an inner surface 20. The illustrated embodiment of the container 10 shows a main body portion which is rectangular in section and has a central axis. The hollow finish 16 provides communication with the hollow interior of the container 10.

The outer surface 18 of the finish 16 is provided with a locking means adapted to cooperate with a locking means on the closure 40 which will be explained in detail as the description progresses. The locking means of the finish 16 includes a locking tab 22 which has an upper surface 24 which slopes downwardly and outwardly from the outer surface 18 of the finish 16. The distal end of the sloping surface 24 is caused to merge with the distal end of a lower surface 26 which extends horizontally outwardly from the outer surface 18 of the finish 16.

Spreading and lifting cam members are disposed on opposite sides of the locking means to effect an unlocking and opening function. More specifically, the spreading cams are designated by reference numerals 28 and 28', respectively, and the lifting cams are designated by reference numerals 30 and 30', respectively. As will be apparent from a study of the drawings, the spreading cams 28 and 28' includes cam surfaces which extend outwardly from the outer surfaces of the finish of the container 10; and the lifting cams 30 and 30' include cam surfaces which extend upwardly in respect of the finish of the container 10. It will be observed that the surfaces of the spreading cams 28 and 28'; and the lifting cams 30 and 30' extend in opposite horizontal directions from one another and are operative to spread and lift an associated locking cam on the closure 40 upon effecting relative clockwise or counterclockwise rotational movement between the closure 40 and the container 10, as will be explained in greater detail hereinafter.

The closure 40 of the embodiment illustrated in FIGS. 1, 2, and 3 includes a generally flat planar top portion 42 which is square in shape with slightly rounded corners. A skirt 44 depends from the marginal edges of the top portion 42. The outer surface of the skirt 44 has rounded corners which conform with the shape of the corners of the top portion 42.

The closure 40 is provided with spaced apart locking means each of which includes a locking tab 46 which has a lower surface 48 which slopes upwardly from the inner surface of the skirt 44. The distal end of the sloping surface 48 is caused to merge with the distal end of a surface 49 which extends horizontally outwardly from the inner surface of the skirt 44 of the closure 40.

The locking means of the container 10 and of the closure 40 are disposed generally midway between the respective rounded corners of the finish 16 of the container 10 and the inner surface of the skirt 44 of the closure 40. Thus, the locking tabs 22 and 46 register with one another when in a closed position to provide the desired locking of the closure 40 to the container 10.

Figure 4A:
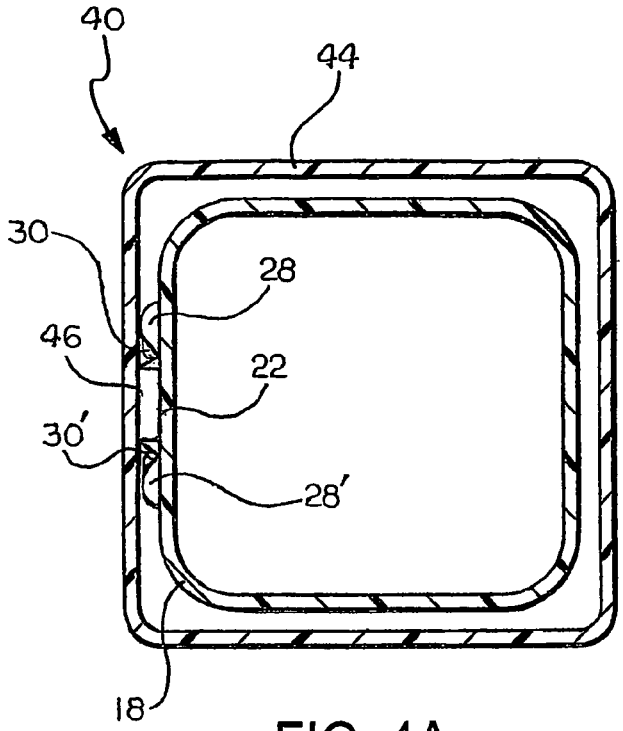
FIGS. 4A, 4B, 4C, and 4D are top plan views in section illustrating the removal of the closure from the container illustrated in FIGS. 1 through 3.

In operation, when it is desired to release the closure 40 from the container 10, attention is directed to FIGS. 4A, 4B, 4C, and 4D which illustrate the deflection sequence of relative positions of the closure 40 and the container 10 during a typical opening operation thereof. FIG. 4A illustrates a combination of a container 10 and an associated closure 40 which is generally rectangular in plan and is provided with a locking means disposed midway of the corners of the finish of the container 10 and the inner surface of the depending skirt or rim of the closure 40. However, sake of simplicity and ease of description and consequent understanding, only a single locking mechanism is illustrated in FIGS. 4A, 4B, 4C, and 4D.

Figure 4B:
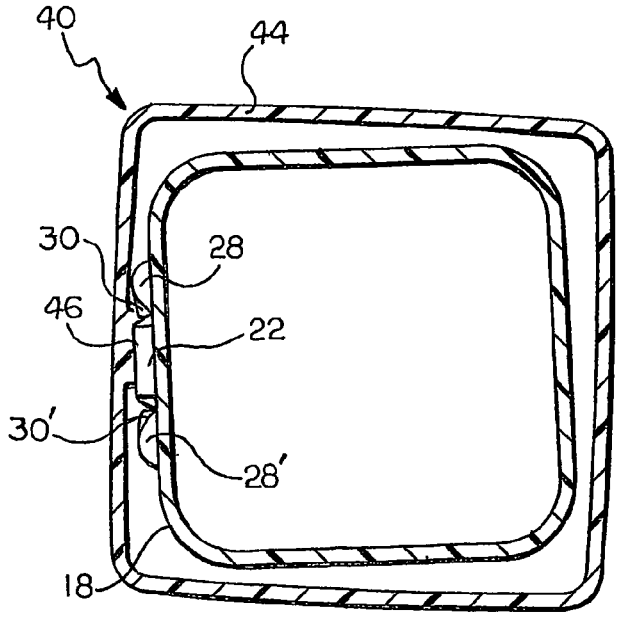

FIG. 4B shows the closure 40 having been rotated approximately five (5°) degrees relative to the finish of the container 10. It will be noted that the closure locking tab 46 has been caused to come into slidable contact with the spreading cam 28 to cause the skirt 44 to commence flexing outwardly away from the outer surface of the finish 16 of the container 10. The lower surface of the locking tab 46 has commenced contact with the lifting cam 28 to start upward movement of the closure 46 in respect of the closure 10. However, the closure 40 is still firmly secured to the container 10.

Figure 4C:
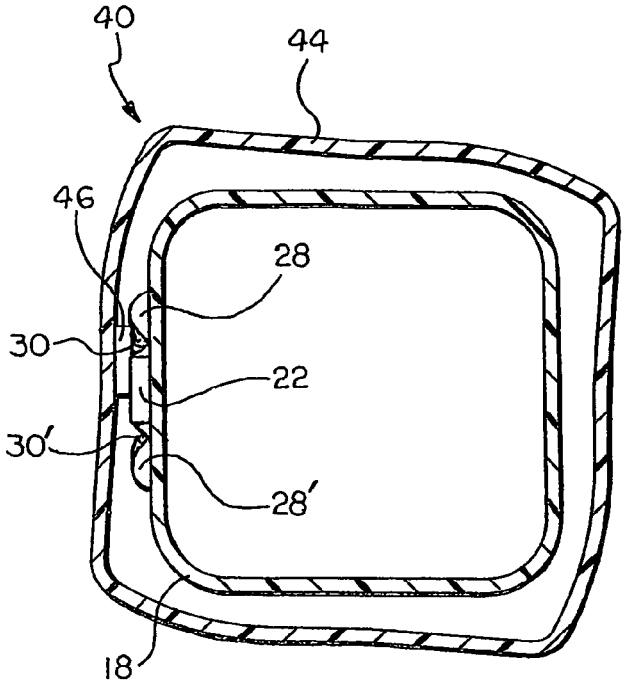

FIG. 4C shows the closure 40 having been rotated approximately ten (10°) degrees relative to the fully closed position as illustrated in FIG. 4A and an additional five (5°) degrees of rotation therein illustrated in FIG. 4B. The locking tab 46 of the closure 10 is in full slidable contact with the spreading earn 28 of the closure 10 causing maximum flexing of the skirt 44 away from the outer surface of the finish 16 of the container 10, and the lower surface of the locking tab 46 has been caused to be caromed upwardly by the lifting cam 30 to further lift the closure 40 in respect of the container 10. The closure 40 is still secured to the container 10.

Figure 4D:
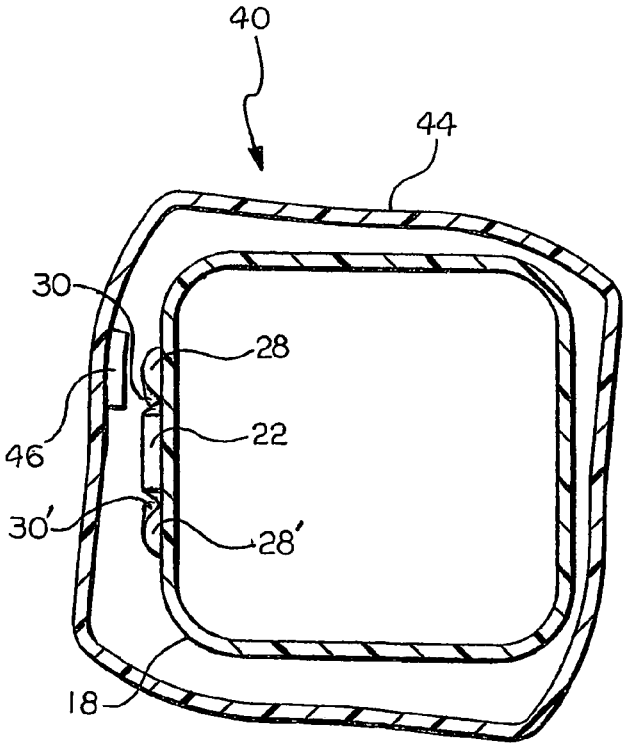

FIG. 4D illustrates the closure 40 having been rotated approximately fifteen (15°) degrees relative to the fully closed position as illustrated in FIG. 4A. The locking tab 46 has been moved outwardly to the maximum flexing of the spreading cam 28 and the lifting cam 30. This action has caused the lower surface of the locking tab 46 to be lifted to the fullest extent. The closure 40 is now fully independent of the container 10 as illustrated in FIG. 4D.

It will be appreciated from the above description from both the structural aspects, as well as the operational aspect that the illustrated embodiment has surprisingly produced a container and closure combination that includes a readily actuated assist for opening and closing the container. This feature has been characterized and referred to as the "snap-on/pop-off" feature. The feature is particularly attractive to users afflicted with arthritis and other muscular diseases and disorders which impair the use of one's hands in the removal of container closures, for example.

The opening assist is typically accomplished by the means for lifting the closure and the means for spreading the skirt of the closure away from the finish of the container. As described, the lifting means includes a lifting cam extending outwardly from the finish of the container over which the closure-locking tab is caused to slide as the closure is being removed. The lifting cam has an upper surface which slopes upwardly to guide the upward movement of the locking tab on the closure. The spreading cam extends outwardly from the outer surface of the finish of the container. The outermost edge of the locking tab of the closure is caused to slide along the spreading cam surface, thereby causing the skirt of the closure to spread the flexible skirt of closure away from the finish of the container. The spreading cam may include a single ramp or alternatively, may include a two-side ramp (one being an inclined ramp or an inclining ramp and a declining ramp). Further, it will be understood that the number of lifting cams and spreading cams may vary. Preferably, two spreading cams and two lifting cams associated with each of the locking tabs and are disposed at opposite sides thereof. Preferably, the cams are disposed on the finish of the container, and the locking tab to be flexed is positioned on the flexible portion of the downwardly depending relatively flexible skirt of the closure. However, the elements may be interchanged within the locking tab extending outwardly from the finish of the container and the cams extending inwardly from the inner surface of the depending skirt of the closure. In the last mentioned embodiment, the finish of the container could be formed of a flexible material, while the skirt of the closure could be formed of a more rigid material.

The spreading and lifting means are effective to guide the associated closure locking tab from engagement with the container locking tab in a precise manner, to thereby efficiently and effectively spread and then lift the flexible closure away from the finish of the container minimizing the amount of torque required to remove the closure from the container. In this manner, the closure will literally "pop off" in the user's hand when the closure is gently or lightly rotated either clockwise or counterclockwise.

Figure 5:
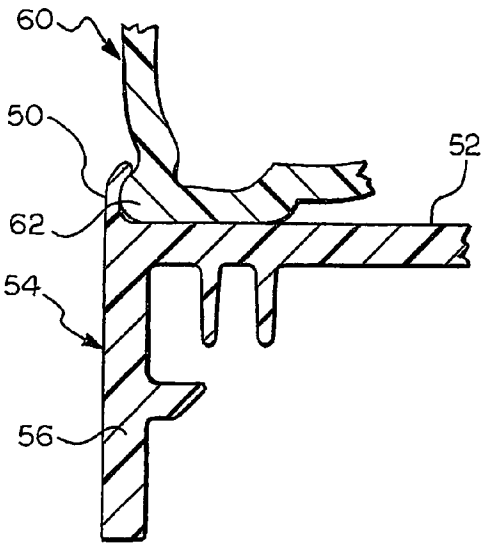
FIG. 5 is a fragmentary sectional view of an alternative embodiment of a closure incorporating stacking and sealing structures.

FIG. 5 shows an embodiment of the invention which includes a means for stacking on top of one another. The stacking means consists of the provision of a flange 50 which extends upwardly from the peripheral edge of the upper surface 52 of a closure 54. The closure 54 is formed with a depending skirt 56 which includes a locking system as described in the description and illustration in respect of embodiments as illustrated in FIGS. 1 through 4, for example. The flange 50 is configured to receive the bottom of a container 60. The bottom of the container 60 is provided with an outwardly extending projection 62 which typically extends around the circumference of the base of the container 60. The flange 50 may be continuous or intermittent and is typically formed with sufficient elasticity to selectively receive and frictionally engage a complimentary projection 62 of a superposed container 60. Thus, a structural feature is provided to enable the stacking of containers, one on another, to efficiently make use of storage and/or display space.

Figure 7:
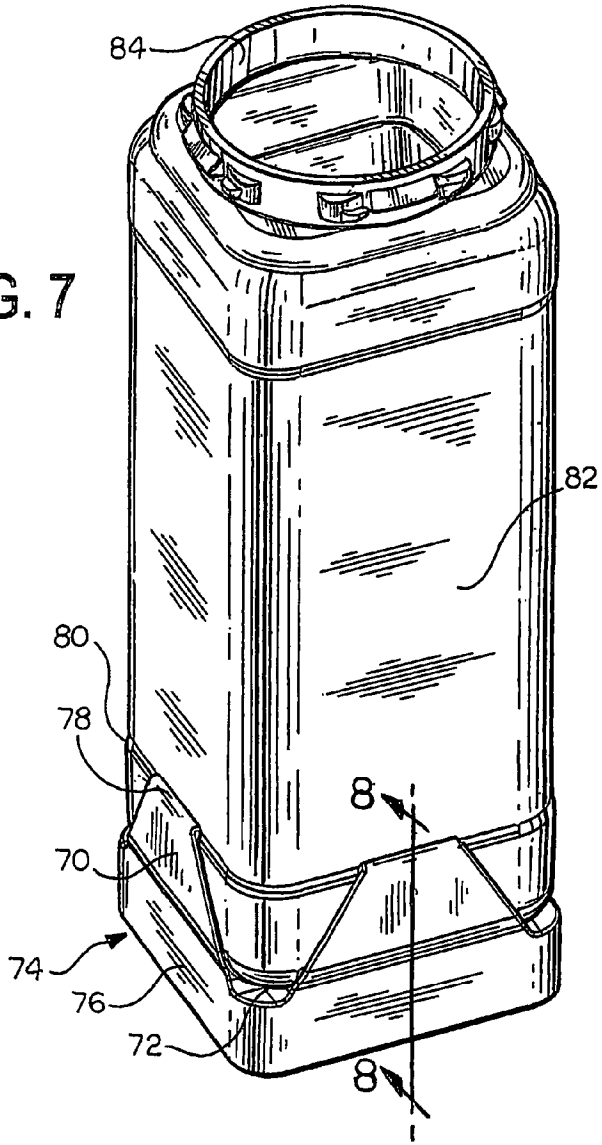
FIG. 7 is a fragmentary perspective view of the closure illustrated in FIG. 6 in operative position.
Figure 6:
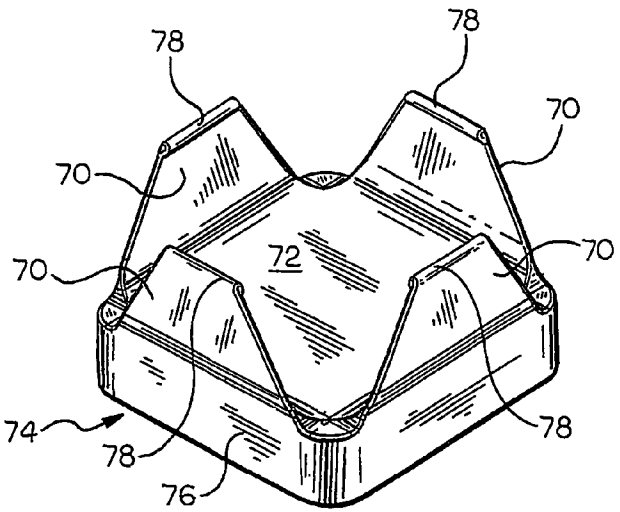
FIG. 6 is a perspective view of a closure illustrating an alternative stacking structure.

FIGS. 6 and 7 show another embodiment of the invention useful for stacking the container and closure combination on top of one another. More specifically, the embodiment illustrated in FIGS. 6-7 includes a stacking means which consists of plurality of spaced apart upstanding flanges 70 which extend upwardly from the peripheral edge of the upper surface 72 of an associated closure 74. The closure 74 includes a downwardly depending skirt 76 which extends around the marginal edge of the upper surface 72. The lower portions of the flanges 70 are integral with the upper edges of the skirt 76, as illustrated. Each of the distal ends of the flanges 70 is provided with a protrusion 78 configured to be received by a suitable complimentary ridge 80 formed on the outer surface of a stacked container 82 as clearly illustrated in FIGS. 7 and 8.

Figure 9:
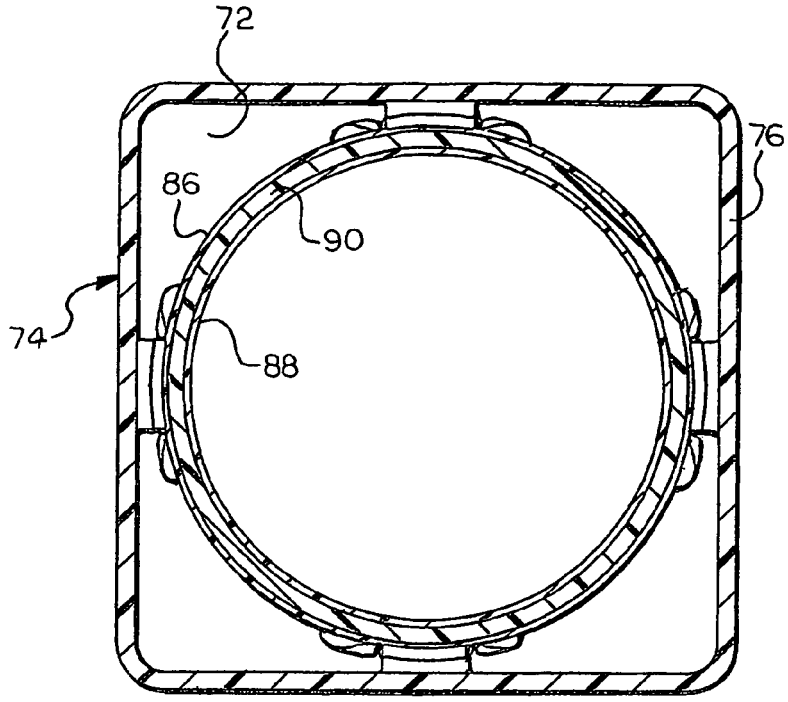
FIG. 9 is a sectional plan view of the closure, container and associated seal illustrated in FIGS. 7 and 8.
Figure 8:
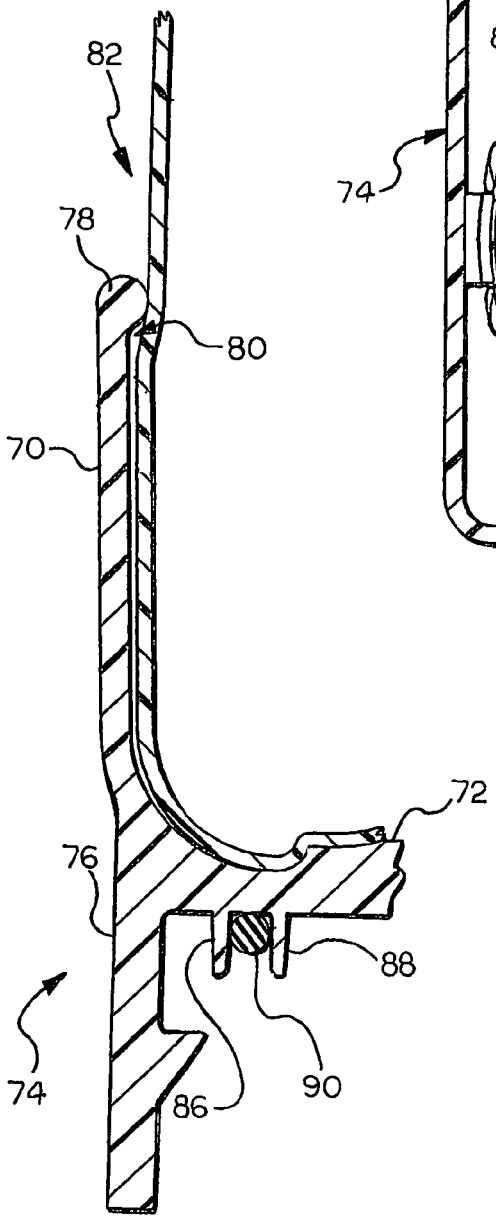
FIG. 8 is a fragmentary sectional view taken along line 8-8 of FIG. 7.

The bottom or inside configuration of the closure 74 the embodiment illustrated in FIGS. 7 and 8 is clearly illustrated in FIG. 9. The illustrated structure effects a sealing relationship between the container 82 and the closure 74. More particularly, the closure 74 is provided with a pair of concentric spaced apart annular walls 86 and 88. The walls 86 and 88 are positioned to generally align with and span the sides of the open end of the finish 84 of the container 82. An elastomeric O-ring seal 90 is retained within the space between the adjacent facing surfaces of the walls 86 and 88. When the closure 74 is in a closed position on the finish 84 of the container 82, the O-ring seal 90 sealingly engages the upper annular outlet of the finish 84.

The embodiment illustrated in FIGS. 7, 8, and 9 differ from the embodiment illustrated in FIGS. 1 through 4 in the shape of the respective finishes of the containers and the shape of the associated closure. Nevertheless, the latching and unlatching mechanism is substantially identical in structural and function. In each instance, the combination includes a container having a finish which defines an opening therefor, and an cooperating closure. The finish may be circular or polygonal. The container may be annular, but for many reasons is preferably polygonal. A square shaped or rectangular shaped container body is preferred because of the more efficient use of space, as compared with an annularly shaped body.

Throughout the preceding description and accompanying illustrations, the spreading cam surfaces and the lifting cam surfaces were illustrated as bring integral with the outer surface of the finish of the container and the cooperating locking tab was integral with the inner surface of the depending skirt of the closure. In such embodiment, it has been found that maximum operation is achieved by forming the skirt of the closure to be formed of a more flexible and/or thinner material than the material of the finish of the container. Thereby, the spreading cam can readily spread the skirt of the closure and facilitate the lifting and eventual removal of the closure from the container.

It will be understood that the structure may be reversed by forming the spreading cam and lifting cam integral with the skirt of the closure. In such an embodiment, relative flexing would necessarily be built into the closure and/or container to facilitate the closure and opening of the container.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. A container and closure combination comprising:

a container including a bottom wall, an associated side wall defining a hollow interior, a finish having an outer surface and an inner surface, the finish providing communication with the hollow interior and having a central axis, and a first locking means on the outer surface of the finish;

a spreading cam and a lifting cam disposed on the outer surface of the finish, wherein at least one of the spreading cam and the lifting cam is adjacent the first locking means; and a closure to cover the finish of said container including a second locking means cooperating with the first locking means of said container, said closure having a central axis, whereby upon relative rotational movement of said closure and said container, the spreading cam causes the first locking means of said container and the second locking means of said closure to flex away from one another transversely of the central axis of said container and said closure and the lifting cam causes relative axial motion of said container and said closure generally parallel to the central axis of said container and said closure to effectively separate said closure from the finish of said container.

2. The combination defined in claim 1 wherein the first locking means of said container includes a locking tab.

3. The combination defined in claim 2 wherein the locking tab extends outwardly from the finish of said container.

4. The combination defined in claim 3 wherein the locking tab includes a cam surface.

5. The combination defined in claim 1 wherein the spreading cam and the lifting cam are adjacent to the locking tab.

6. The combination defined in claim 5 wherein the locking tab is centered between the spreading cam and the lifting cam.

7. The combination defined in claim 2 wherein the second locking means of said closure includes a locking tab.

8. The combination defined in claim 7 wherein said closure includes a main body and a skirt depending therefrom.

9. The combination defined in claim 8 wherein the locking tab of the second locking means of said closure extends inwardly from the skirt.

10. The combination defined in claim 9 wherein said closure includes an upstanding flange.

11. The combination defined in claim 10 wherein said upstanding flange is formed to receive the bottom wall of a stacked one of said container.

12. The combination defined in claim 1 wherein at least one of said container and said closure is formed of a readily deformable material.

13. The combination defined in claim 12 wherein said material is plastic.

14. The combination defined in claim 13 wherein said plastic material is flexible.

15. The combination defined in claim 14 wherein said plastic material is polyethylene terephthalate (PET).

16. The combination defined in claim 1 wherein the cross-section of the finish of said container taken perpendicular to the central axis is polygonal.

17. The combination defined in claim 1 wherein the cross-section of the finish of said container is round.

18. The combination defined in claim 1 wherein the cross-section of said closure taken perpendicular to the central axis is polygonal.

19. The combination defined in claim 1 wherein the cross-section of said closure taken perpendicular to the central axis is round.

20. The combination defined in claim 1 wherein the first locking means of said container is comprised of a plurality of spaced apart locking tabs and associated lifting cams and spreading cams.

21. The combination defined in claim 1 wherein the second locking means of said closure is comprised of a plurality of spaced apart locking tabs and an associated spreading cam and lifting cam.

22. The combination defined in claim 8 wherein the main body of said closure includes an elastomeric seal for covering and sealing the finish of said container.

* * * * *

UNITED STATES PATENT AND TRADEMARK OFFICE

CERTIFICATE OF CORRECTION

PATENT NO. : 7,731,050 B2
APPLICATION NO. : 10/555047
DATED : June 8, 2010
INVENTOR(S) : Parks et al.

It is certified that error appears in the above-identified patent and that said Letters Patent is hereby corrected as shown below:

Column 4, line 31, delete “earn”, and insert -- cam --.

Column 4, line 46, delete “caromed”, and insert -- cammed --.

Signed and Sealed this

Twelfth Day of October, 2010

David J. Kappos

David J. Kappos
*Director of the United States Patent and Trademark Office*